US006347896B1

(12) United States Patent
Robinson

(10) Patent No.: US 6,347,896 B1
(45) Date of Patent: Feb. 19, 2002

(54) CUTTING MODE SWITCHING MODULE IN A PRINTER

(75) Inventor: Carl Wesley Robinson, Charlotte, NC (US)

(73) Assignee: XAC Automation Corporation, Hsinchu (TW)

( * ) Notice: Subject to any disclaimer, the term of this patent is extended or adjusted under 35 U.S.C. 154(b) by 0 days.

(21) Appl. No.: 09/695,316

(22) Filed: Oct. 25, 2000

(51) Int. Cl.[7] ..... B41J 11/70; B41J 11/66

(52) U.S. Cl. ..... 400/621; 400/613; 83/51; 83/601; 83/602

(58) Field of Search ..... 400/621, 613; 83/51, 553, 563, 564, 601, 602, 603

(56) References Cited

U.S. PATENT DOCUMENTS

| | | | | |
|---|---|---|---|---|
| 5,533,821 A | * | 7/1996 | Awai et al. | 400/619 |
| 5,833,380 A | | 11/1998 | Hosomi et al. | 400/621 |
| 6,113,294 A | * | 9/2000 | Niwa | 400/621 |

FOREIGN PATENT DOCUMENTS

| | | | |
|---|---|---|---|
| JP | 54-123480 | | 8/1979 |
| JP | 2-10953 | | 1/1990 |
| JP | 6-238970 | | 8/1994 |
| JP | 9-19890 A | * | 1/1997 |
| JP | 11-1035 A | * | 1/1999 |

* cited by examiner

*Primary Examiner*—Daniel J. Colilla
(74) *Attorney, Agent, or Firm*—Sughrue Mion, PLLC

(57) ABSTRACT

Disclosed is a printer including: a fixed chassis mounted on the printer; a moving chassis being engageable with the fixed chassis between an open position and a closed position; and a cutting mode switching module for controlling a cutting mode of the printer, characterized in the cutting mode switching module comprising: a fixed blade mounted at the fixed chassis; a moving blade having an elongated pivot hole, through which pivot hole the moving blade is pivoted to a pivot end of the moving chassis such that the moving blade is shiftable within the pivot hole between a first position and a second position, and such that the fixed blade and moving blade is formed with a paper path therebetween when the moving chassis is at the closed position; a motor mounted in the moving chassis; and a crank pin engaging with and cranking the moving blade and driven by the motor to rotate in a first direction or a second direction; whereby when the moving chassis is at the closed position, the moving blade is capable of performing a partial cut or a full cut of the paper passing through the paper path depending on the rotational direction of the motor.

5 Claims, 10 Drawing Sheets

CUTTING MODE SWITCHING MODULE IN A PRINTER

FIELD OF INVENTION

The present invention relates to a printer suitable, for example, for use with electronic cash registers used in point-of-sale (POS) systems and relates, more particularly, to a printer comprising a cutting mode switching module that selectively performs a partial cut or a full cut of paper passing through a paper path as a result of selective rotational direction of a motor driving the cutting mode switching module.

BACKGROUND OF INVENTION

Printers used in point-of-sale (POS) systems generally print to rolled paper as the recording medium using a thermal head or other type of print head, and comprise a cutter to cut the printed paper to obtain a sales receipt that can be handed to the customer.

Typical of the various cutters employed in such printers are cutters that cut the paper by pushing a cutting blade perpendicularly against the paper as described in JP-A-238970/1994, and cutters that cut the recording paper using a fixed blade and a movable blade as described in JP-U-123482/1979. A scissors-type cutter that cuts the recording paper by moving a movable blade across the paper while cutting the recording paper from one edge to the other is also known as described in JP-U-10953/1990, and U.S. Pat. No. 5,833,380.

Conventional scissors-type modules, however, are restricted to cut either along the entire width of the paper or along a partial width of the paper and must be configured for the desired cut at the time or manufacture.

It is thus needed to design a cutting mode switching module that can selectively perform a partial cut or a full cut of paper passing through a paper path in accordance with the user's needs.

SUMMARY OF INVENTION

The object of the present invention is to provide a cutting mode switching module overcoming the problems of the prior art as described above and being able to selectively perform a partial cut or a full cut of paper passing through a paper path as a result of selective rotational direction of a motor driving the cutting mode switching module.

It is a further object of this invention to provide a cutting mode switching module that employs a simple and easy to manufacture construction to obtain the desired effects so as to eliminate the cost that may be needed for providing the switching effect.

Another object of the present invention is to provide a printer including such a cutting mode switching module.

To achieve the above objects, disclosed is a printer including: a fixed chassis mounted on the printer; a moving chassis being engageable with the fixed chassis between an open position and a closed position; and a cutting mode switching module for controlling cutting mode of the printer, characterized in the cutting mode switching module comprising: a fixed blade mounted at the fixed chassis; a moving blade having an elongated pivot hole, through which pivot hole the moving blade is pivoted to a pivot end of the moving chassis such that the moving blade is shiftable within the pivot hole between a first position and a second position, and such that the fixed blade and moving blade is formed with a paper path therebetween when the moving chassis is at the closed position; a motor mounted in the moving chassis; and a crank pin engaging with and cranking the moving blade and driven by the motor to rotate in a first direction or a second direction.

Further objects and advantages of the present invention will become more fully understood from the detailed description of the preferred embodiments given below in conjunction with the accompanying drawings, wherein:

DETAILED DESCRIPTIONS OF EMBODIMENTS

Figure 1:
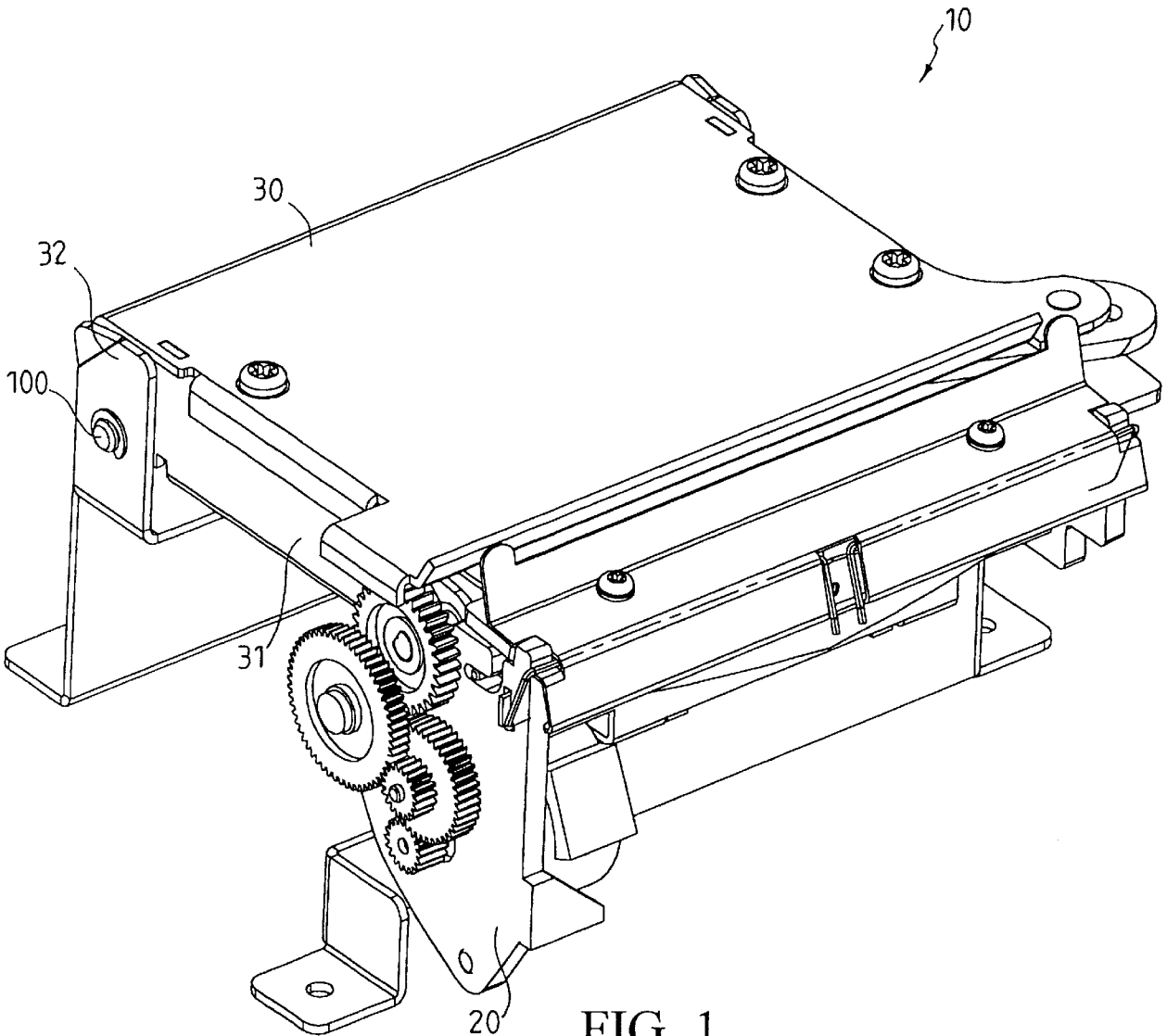
FIG. 1 is perspective view showing a printing mechanism of a printer of this invention.
Figure 2:
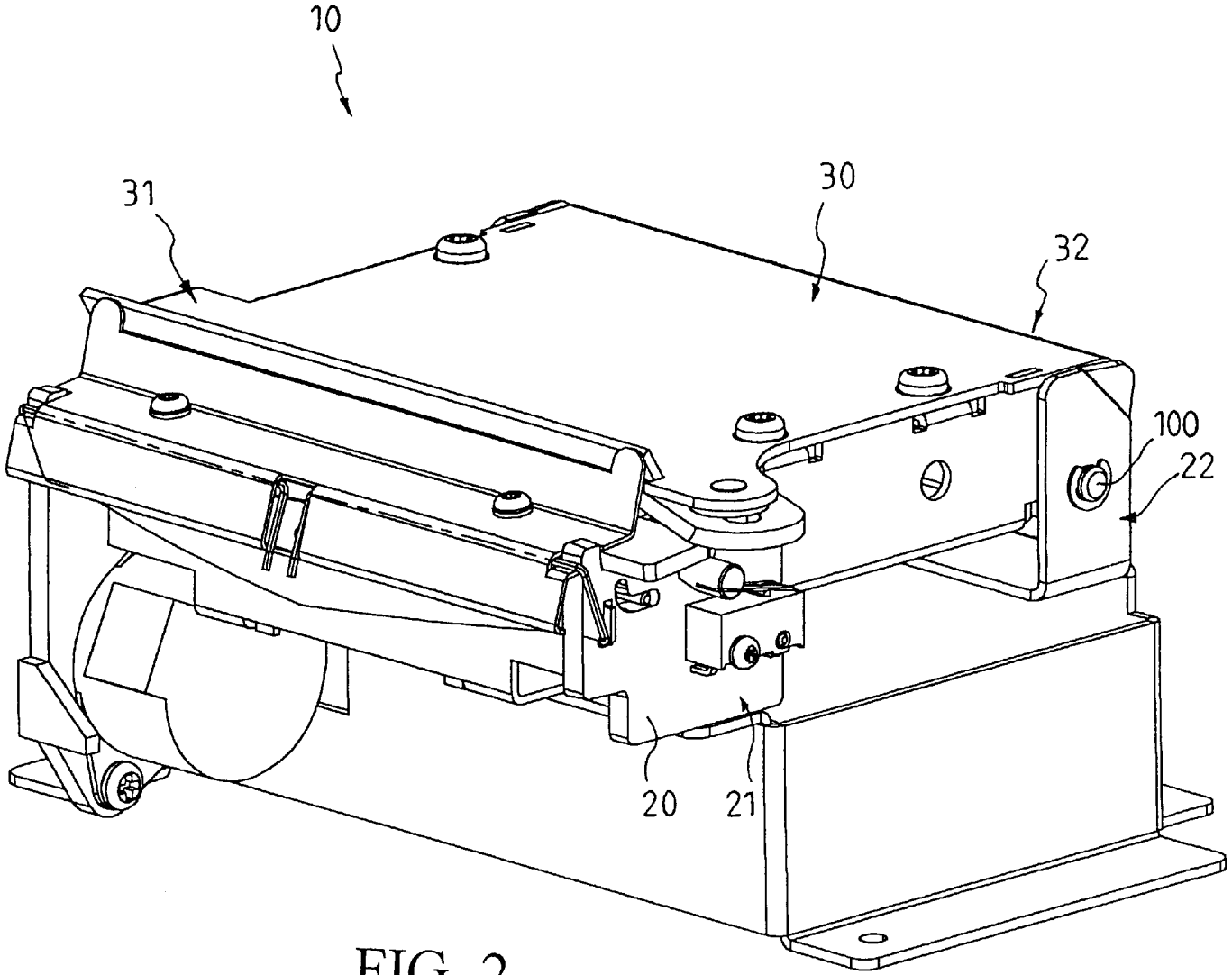
FIG. 2 is another perspective view showing the printing mechanism of FIG. 1.

FIGS. 1 and 2 are perspective views showing a printing mechanism 10 of a printer of this invention. As shown in FIG. 1, the printing mechanism 10 includes a fixed chassis 20 to be mounted on the printer and a moving chassis 30.

Figure 3:
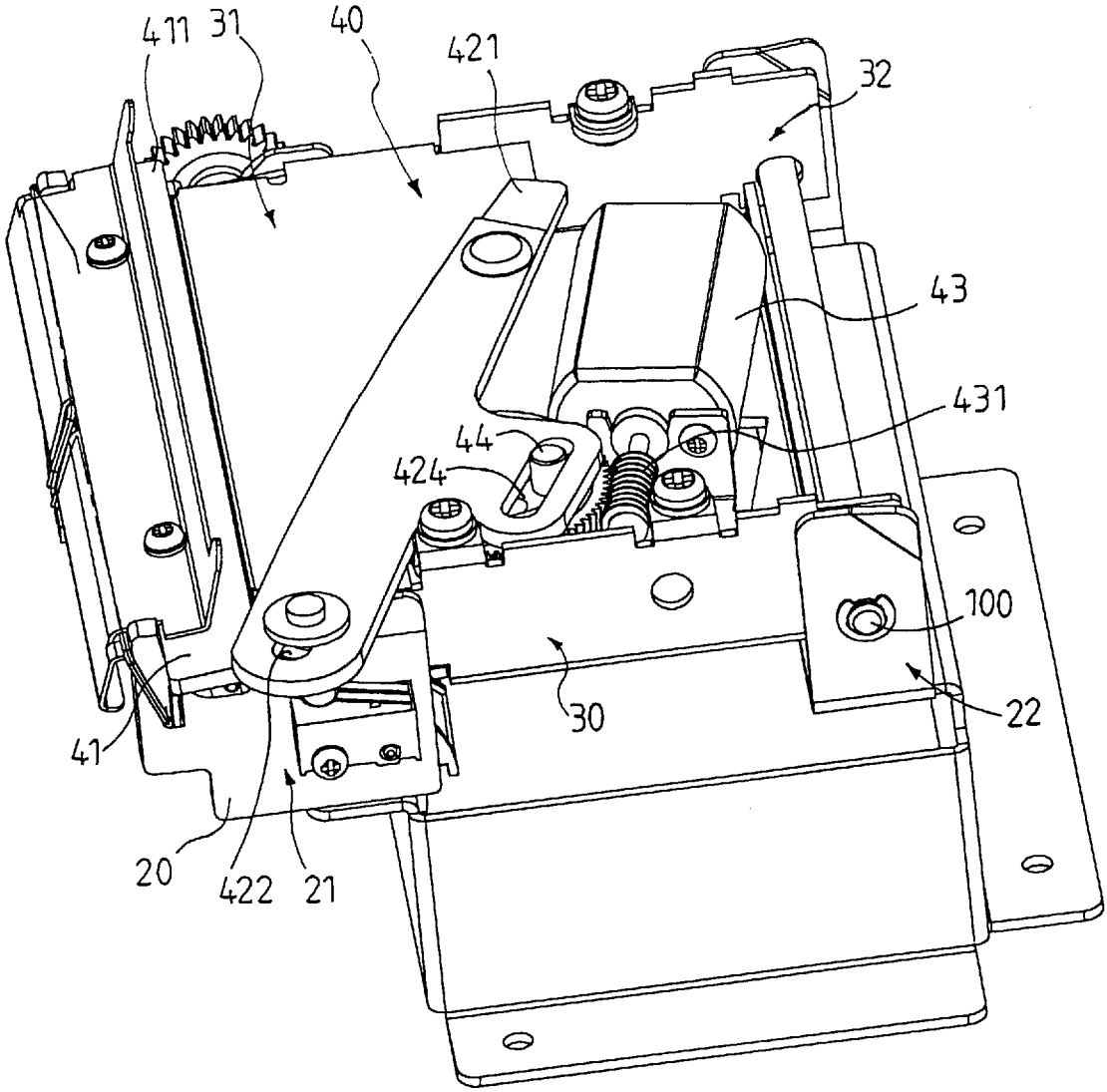
FIG. 3 is a top, perspective view showing interior of the moving chassis of this invention.
Figure 4:
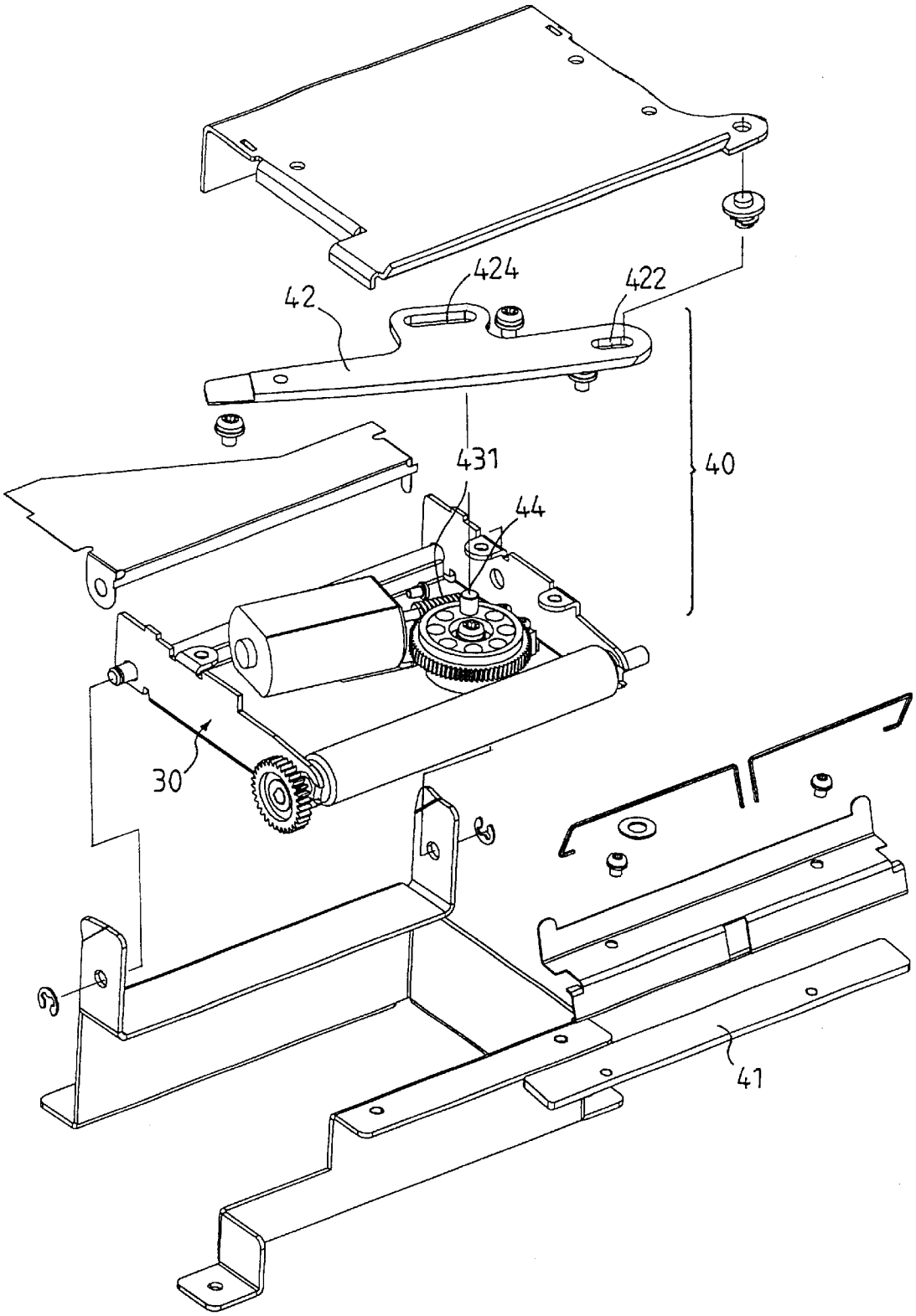
FIG. 4 is an exploded, perspective view showing the cutting mode switching module for use in the printer of this invention.
Figure 5:
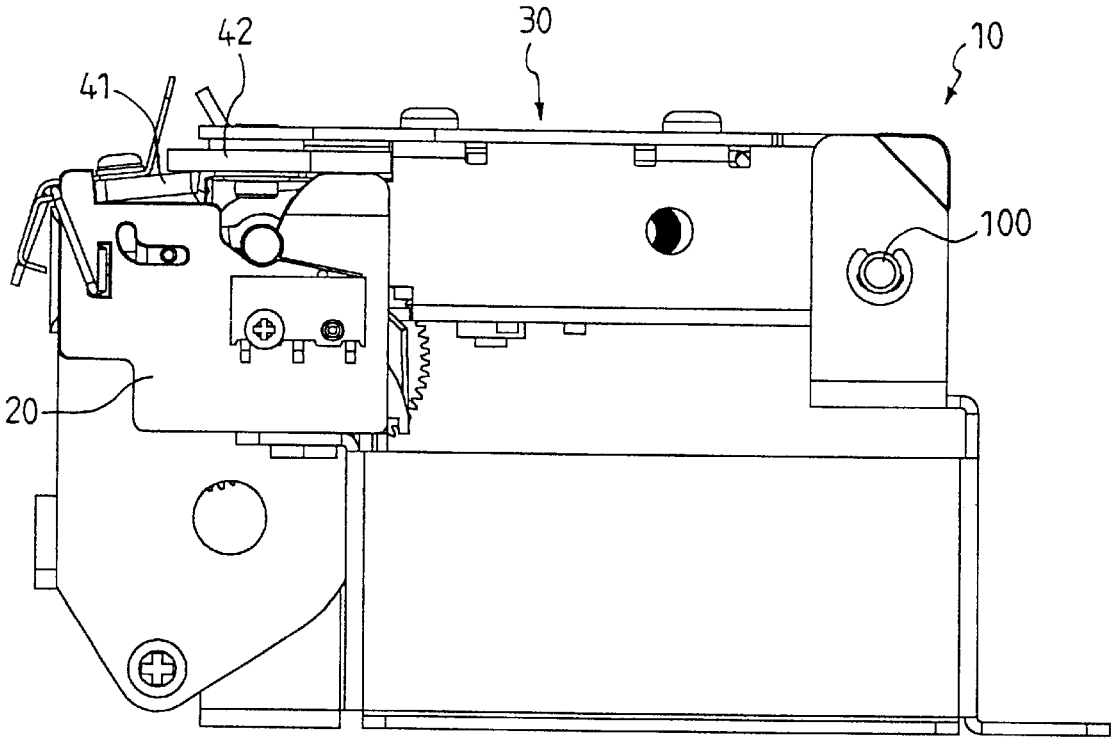
FIG. 5 is a side elevational view showing the engagement relationship of the moving chassis and the fixed chassis of this invention.

FIG. 3 is a top, perspective view showing interior of the moving chassis 30 of this invention. As shown in FIG. 3, the printing mechanism 10 further includes a cutting mode switching module 40 for controlling a cutting mode of the printing mechanism 10. FIG. 4 is an exploded, perspective view showing the cutting mode switching module 40 for use in the printing mechanism 10 of this invention.

Returning to FIG. 1, the moving chassis 30 is engageable with the fixed chassis 20 between an open position that is disengaged from the fixed chassis 20, and a closed position that is engaged with the fixed chassis 20, as shown in FIGS. 1—3. In the invention, the fixed chassis 20 has a first edge 21 and a second edge 22 each having opposing ends; the moving chassis 30 has a first edge 31 and a second edge 32 each having opposing ends. The second edge 22 of the fixed chassis 20 is pivoted to the second edge 32 of moving chassis 30 via a pivot 100 such that the moving chassis 30 is engageable with the fixed chassis 20.

According to an alternative embodiment, the moving chassis 30 may be affixed to a cover (not shown) of the printer, where the cover is pivoted to the printer itself such that the moving chassis 30 is engageable with the fixed chassis 20 via the conventional pivoting arrangement between the cover and the printer.

The cutting mode switching module 40 is best illustrated in FIGS. 3 and 4. As shown in FIG. 3, the cutting mode switch module 40 comprises: a fixed blade 41, a moving blade 42, a motor 43, and a crank pin 44.

The fixed blade 41 is mounted along the first edge 21 of the fixed chassis 20. The moving blade 42 has an elongated pivot hole 422 (best shown in FIG. 4), through which pivot hole 422 the moving blade 42 is pivoted to a pivot end of the first edge 31 of the moving chassis 40 such that the moving blade is shiftable within the pivot hole 442 between a first position, where the moving blade 42 is shifted away from the pivot end of the moving chassis 40 as shown in Location E of FIGS. 7*a* and 7*b*, and a second position, where the moving blade 42 is shifted towards the pivot end of the moving chassis 40, as shown in Location E' of FIGS. 8*a* and 8*b*.

The moving blade 42 has a first end, a second end, and a crank slot 424 (best see in FIG. 3) between the first and the second end; the pivot hole 422 is best formed at the first end of the moving blade 42.

The motor 43 is mounted in the moving chassis 40. The crank pin 44 is mounted at a gear 441 meshed with a worm gear 431 being driven by the motor 43. The crank pin 44 engages the crank slot 424 of the moving blade 42 and is driven by the motor 43 to crank the moving blade 42. The motor 43 is capable of to selectively rotate in a first direction that drives the gear 441 to rotate in a counterclockwise direction, or a second direction that drives the gear 441 to rotate in a clockwise direction.

Figure 6:
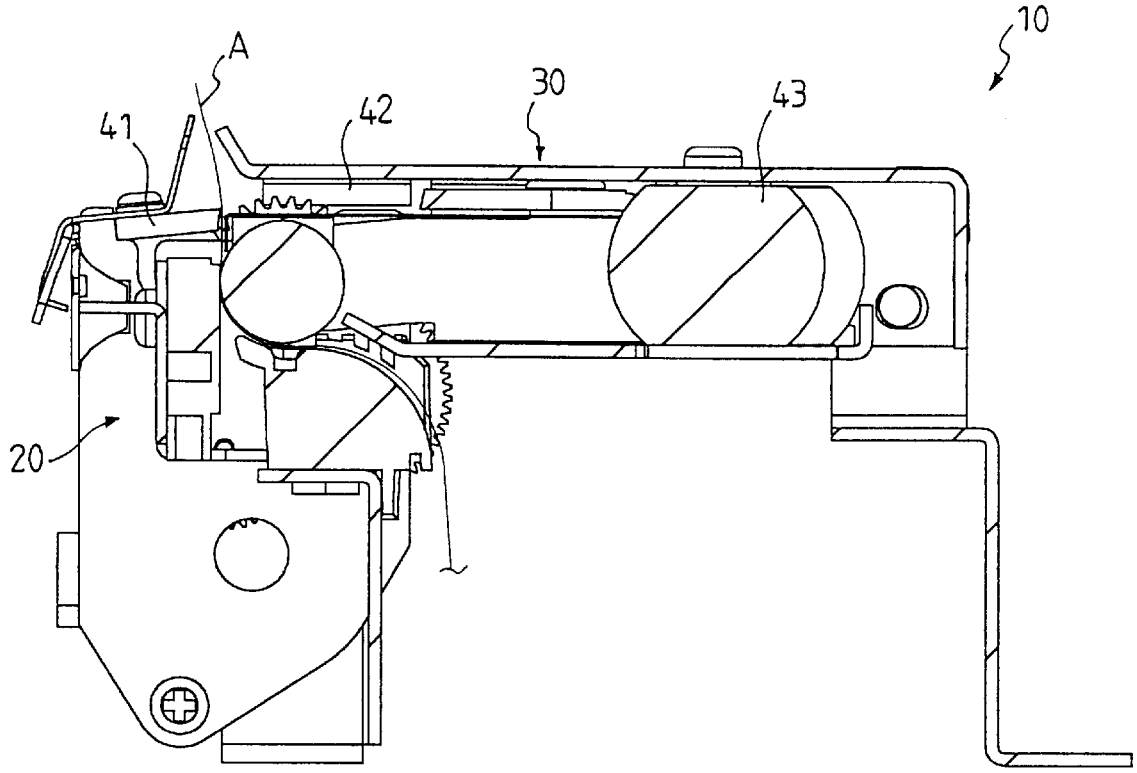
FIG. 6 is a cross-sectional view showing the engagement relationship of the moving chassis and the fixed chassis of this invention.

While operating the cutting mode switching module 40 of this invention, the moving chassis 40 first engages the fixed chassis 30, that is, at the closed position, such that a paper path shown in dotted line A of FIG. 6 is formed between the moving blade 42 and the fixed blade 41.

When the moving chassis 30 is at the closed position, a software command is used to select the desired cutting mode.

Figure 7A:
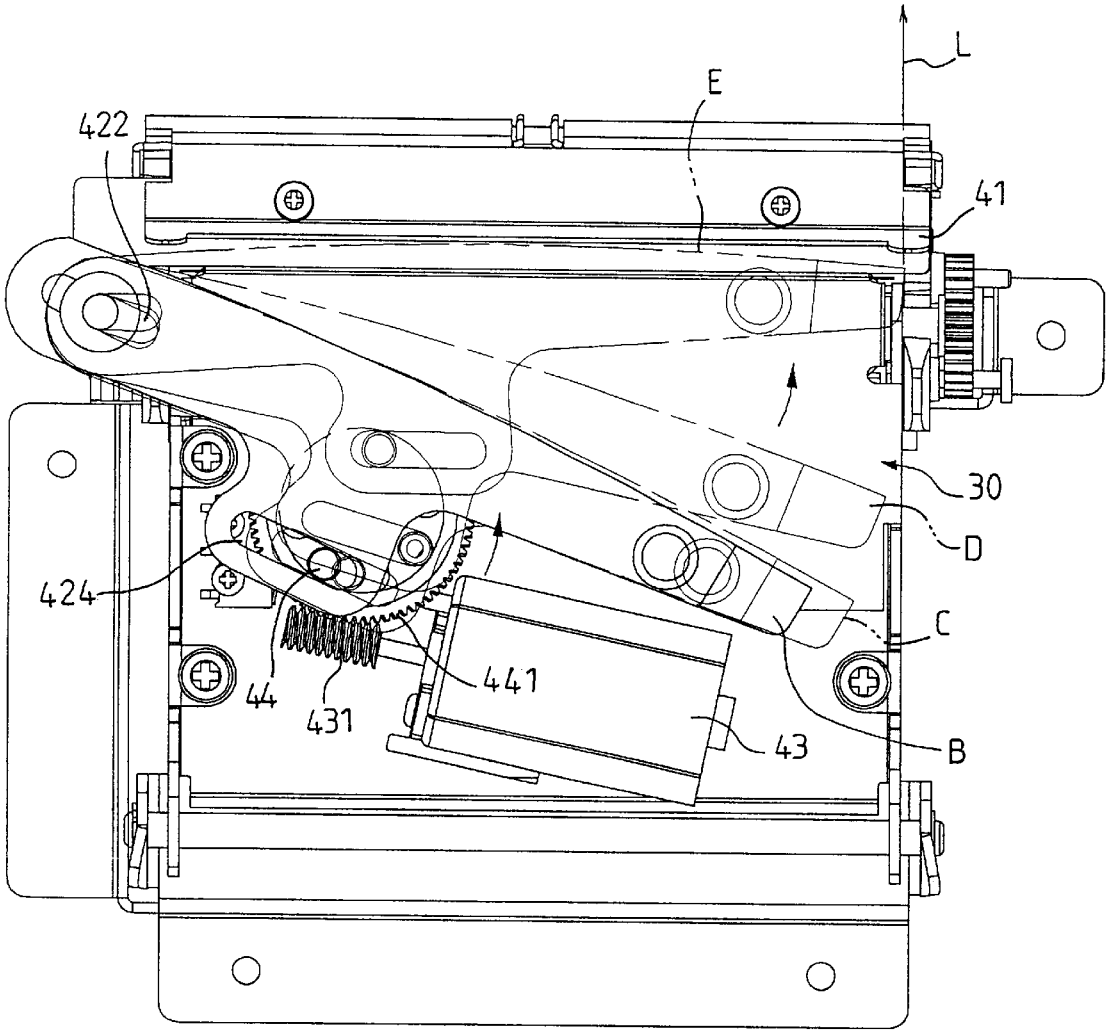
FIG. 7*a* is a top plan view showing the advancement of the moving blade with the motor driving the crank pin to rotate in a counterclockwise direction.
Figure 7B:
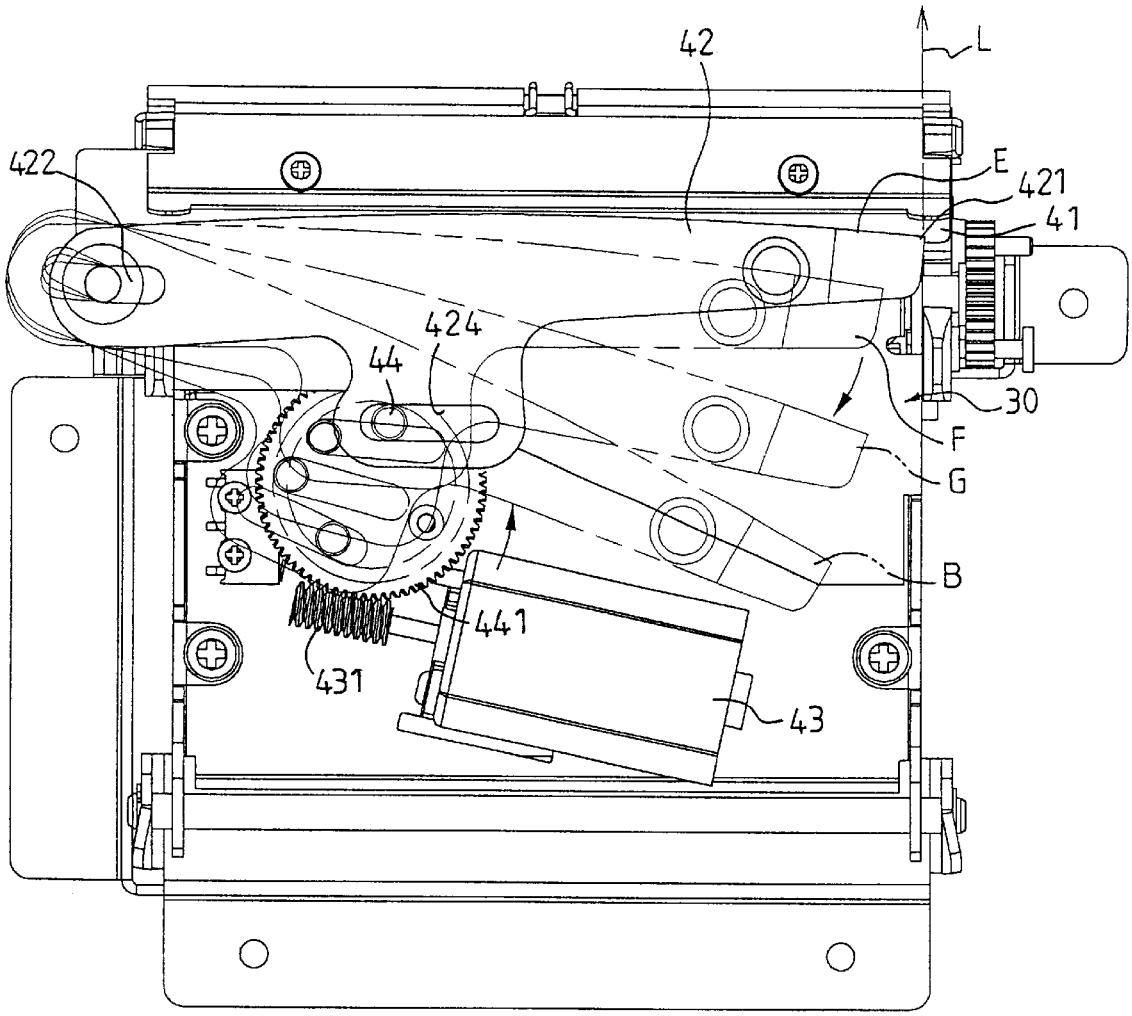
FIG. 7*b* is a top plan view showing the retraction of the moving blade with the motor driving the crank pin to rotate in a counterclockwise direction.

As shown in FIGS. 7*a* and 7*b*, at the beginning, the moving blade 42 is illustrated to locate at Location B, which is a position where the moving blade 42 is shifted towards the pivot end of the moving chassis 40, or known as the second position as described previously. It shall also be noted that the initial location of the moving blade 42 may be anywhere between B and C; the location as illustrated in the drawings are provided for illustrative purposes only.

If the motor 43 is set to drive the crank pin 44 to rotate in the first, counterclockwise direction, the moving blade 42 is cranked to shift from Location B to the first position, that is, Location C where the moving blade 42 is shifted away from the pivot end of the moving chassis 40, as shown in FIG. 7*a*, and then advanced to Location D and then to engage with the fixed blade 41 at Location E of FIG. 7*a*. Because at location E a tip end 421 of the moving blade 42 reaches a very distal end L of the moving chassis 30, engagement of the fixed blade 41 and the moving blade 42 performs a full cut of the paper passing through the paper path A.

As shown in FIG. 7*b*, when the motor 43 continues to drive the crank pin 44, the moving blade 42 is cranked to disengage from the fixed blade 41 from Location E to Locations F, G, and then returned to Location B to wait for the next cutting operation.

The above cranking motion generated by the counterclockwise, rotational motion of the gear 441 through the motor 43 results in a scissor-like motion between the moving blade 42 and the fixed blade 41 to perform the desired full paper cut. In this full paper-cutting mode, the paper is cut along the entire width such that each piece of cut paper is separate from one another, as conventional printers.

Figure 8A:
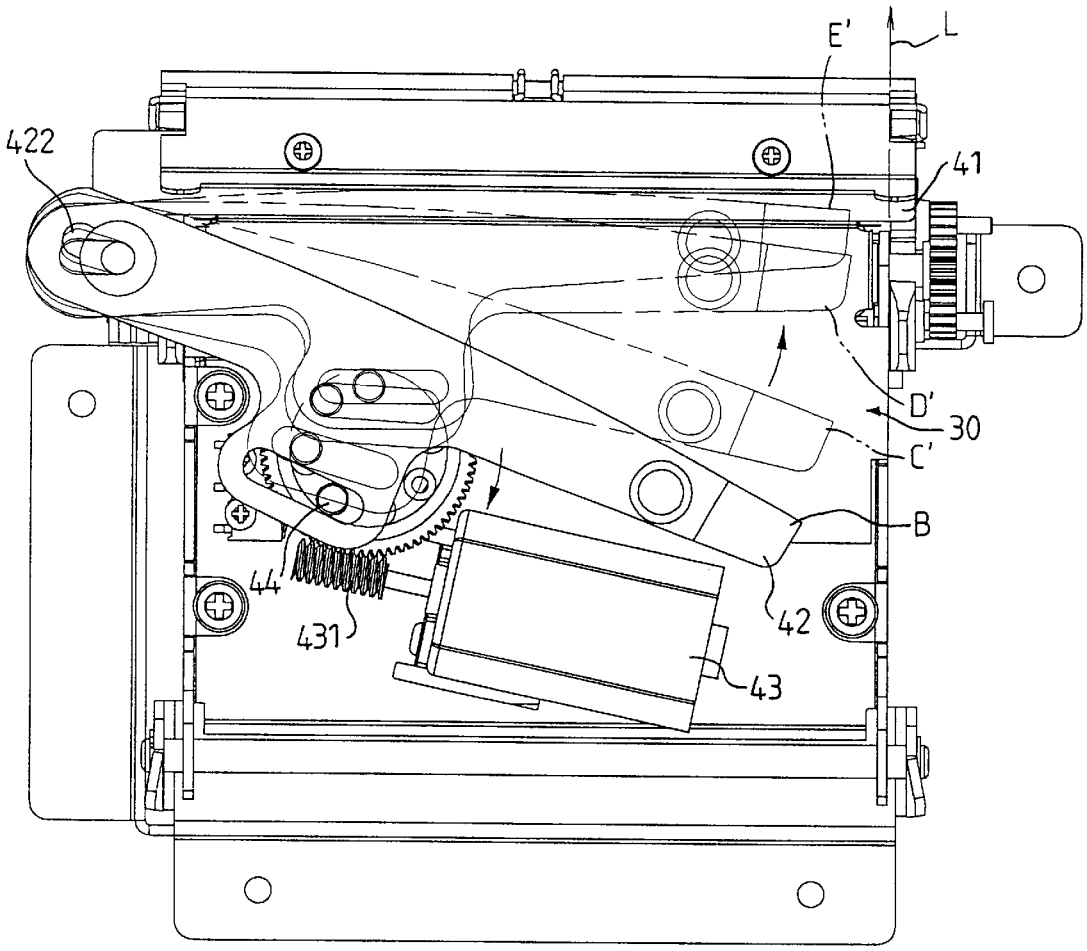
FIG. 8*a* is a top plan view showing the advancement of the moving blade with the motor driving the crank pin to rotate in a clockwise direction.

On the other hand, as shown in FIG. 8*a*, when the moving blade 42 is initially located at Location B, which is also the second position where the moving blade 42 is shifted towards the pivot end of the moving chassis 40, if the motor 43 is set to drive the crank pin 44 to rotate in the second, clockwise direction, the moving blade 42 is cranked to shift from Location B to Location C', and then advanced to Location D' and then to engage with the fixed blade 41 at Location E' of FIG. 8*a*. Because at Location E' the tip end 421 of the moving blade 42 is offset from the very distal end L of the fixed chassis 30, engagement of the fixed blade 41 and the moving blade 42 performs a partial cut of the paper passing through the paper path A, where a width designated by reference numeral d (FIG. 8*a*) of the paper is left uncut.

Figure 8B:
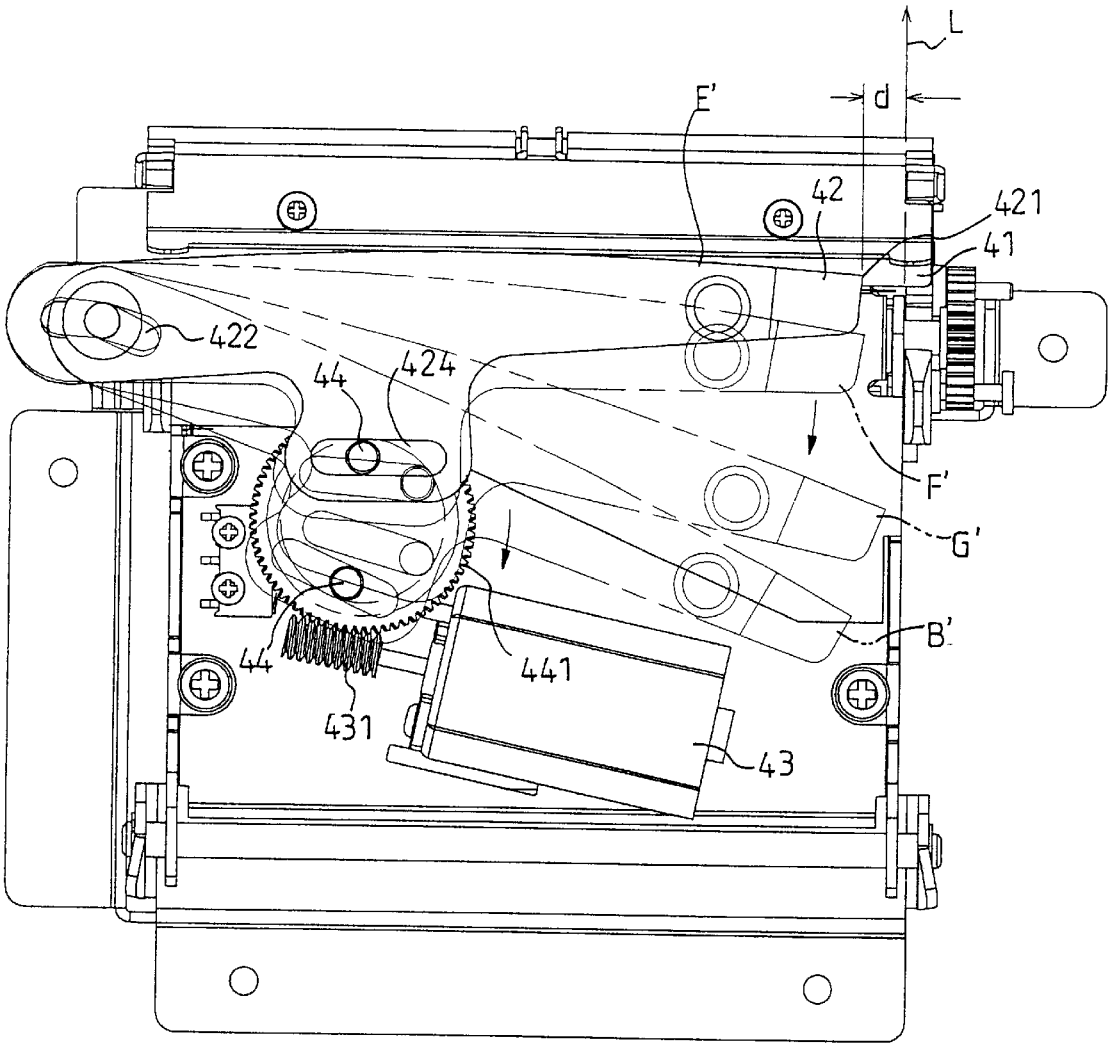
FIG. 8*b* is a top plan view showing the retraction of the moving blade with the motor driving the crank pin to rotate in a clockwise direction.

As shown in FIG. 8*b*, when the motor 43 continues to drive the crank pin 44, the moving blade 42 is cranked to disengage from the fixed blade 41 from Location E' to Location F', G', B' and then returned to Location B of FIG. 8*a* to wait for the next cutting operation.

The above cranking motion generated by the clockwise, rotational motion of the gear 441 through the motor 43 results in a scissor-like motion between the moving blade 42 and the fixed blade 41 to perform the desired partial paper cut. In this partial paper-cutting mode, a very distal end of the paper rolling through the paper path is free from the scissor-like motion between the moving blade 42 and the fixed blade 41, such as 1 to 2 mm, depending on the dimension of the pivot hole 422, of the paper width is left uncut. In such a cutting mode, plurality pieces of paper that contain relevant information may be attached to one another through the 1 mm to 2 mm uncut paper width.

As described above, the present invention provides a moving blade featuring an elongated pivot hole 422, so as to obtain a cutting mode switching module that can selectively perform a partial cut or a full cut of paper passing through a paper path as desired, by merely changing the rotational direction of the motor 43. It is also to be appreciated that the cutting mode switching module of this invention obtains the desired effects through a construction that is simple and easy to manufacture.

Aforementioned explanation is directed to the description of the preferred embodiment according to the present invention. Various changes and implementations can be made by those skilled in the art without departing from the technical concept of the present invention. Since the present invention is not limited to the specific details described in connection with the preferred embodiment except those that may be within the scope of the appended claims, changes to certain features of the preferred embodiment without altering the overall basic function of the invention are contemplated.

What is claimed is:

1. In a printer including: a fixed chassis mounted on the printer; a moving chassis being engageable with the fixed chassis between an open position and a closed position; and a cutting mode switching module for controlling a cutting mode of the printer, characterized in the cutting mode switching module comprising:

a fixed blade mounted at the fixed chassis;

a moving blade having an elongated pivot hole, through which pivot hole the moving blade is pivoted to a pivot end of the moving chassis such that the moving blade is shiftable within the pivot hole between a first position and a second position, and such that the fixed blade and moving blade is formed with a paper path therebetween when the moving chassis is at the closed position;

a motor mounted in the moving chassis; and a crank pin engaging with and cranking the moving blade and driven by the motor to rotate in a first direction or a second direction;

whereby when the moving chassis is at the closed position and the motor drives the crank pin to rotate in the first direction, the moving blade is shifted to the first position and cranked to alternatively engage with and disengage from the fixed blade to perform a full cut of the paper passing through the paper path; and when the motor drives the crank pin to rotate in the second direction, the moving blade is shifted to the second position and cranked to alternatively engage with and disengage from the fixed blade to perform a partial cut of the paper passing through the paper path.

2. In the printer of claim 1, wherein the moving blade having a first end, a second end, and a crank slot between the first and the second end, the pivot hole being formed at the first end of the moving blade, and the crank pin engaging the crank slot.

3. In the printer of claim 1, wherein the moving blade at the first position is shifted away from the pivot end of the moving chassis, and the moving blade at the second position is shifted towards the pivot end of the chassis.

4. In the printer of claim 1, wherein:

the fixed chassis has a first edge and a second edge each having opposing ends, the fixed blade being mounted next to the first edge of the fixed chassis; and the moving chassis having a first edge and a second edge each having opposing ends, the second edge of the fixed chassis being pivoted to the second edge of moving chassis such that the moving chassis is engageable with the fixed chassis, the pivot end being located on the first edge of the moving chassis.

5. In the printer of claim 1, wherein the crank pin is mounted at a gear meshed with a worm gear being driven by the motor.

* * * * *